US012746633B2

(12) United States Patent
Uchikado et al.

(10) Patent No.: US 12,746,633 B2
(45) Date of Patent: Sep. 29, 2026

(54) NON-TRANSITORY COMPUTER-READABLE STORAGE MEDIUM, METHOD OF MANAGING EYEGLASSES LENS MACHINING APPARATUS, AND EYEGLASSES LENS MACHINING APPARATUS

(71) Applicant: NIDEK CO., LTD., Aichi (JP)

(72) Inventors: Yuki Uchikado, Gamagori (JP); Motoki Hirota, Gamagori (JP)

(73) Assignee: NIDEK CO., LTD., Gamagori (JP)

( * ) Notice: Subject to any disclaimer, the term of this patent is extended or adjusted under 35 U.S.C. 154(b) by 783 days.

(21) Appl. No.: 18/191,552

(22) Filed: Mar. 28, 2023

(65) Prior Publication Data

US 2023/0311266 A1 Oct. 5, 2023

(30) Foreign Application Priority Data

Mar. 31, 2022 (JP) ..... 2022-058806

(51) Int. Cl.
*B24B 13/06* (2006.01)
*B24B 51/00* (2006.01)

(52) U.S. Cl.
CPC ..... *B24B 13/06* (2013.01); *B24B 51/00* (2013.01)

(58) Field of Classification Search
CPC ..... B24B 13/06; B24B 51/00; B24B 47/225; B24B 9/144; B24B 9/148; B24B 9/14
USPC ..... 451/5, 240, 42
See application file for complete search history.

(56) References Cited

U.S. PATENT DOCUMENTS 4,711,035 A * 12/1987 Logan ..... G02C 7/021 409/80
2002/0026262 A1* 2/2002 Okada ..... B24B 9/144 700/164
2011/0076923 A1* 3/2011 Takeichi ..... B24B 9/146 451/8

(Continued)

FOREIGN PATENT DOCUMENTS

FR 2910647 A1 * 6/2008 ..... B24B 9/146
JP 2011-73134 A 4/2011

(Continued)

OTHER PUBLICATIONS

Search Report issued Aug. 31, 2023 by the European Patent Office in counterpart European Patent Application No. 23164656.3.

*Primary Examiner* — Joel D Crandall
(74) *Attorney, Agent, or Firm* — Sughrue Mion, PLLC

(57) ABSTRACT

An eyeglasses lens machining apparatus works to perform a check operation implementation step of causing the apparatus to implement a check operation for checking a malfunction state of an operation of the apparatus, a self-restoration step of updating a calibration state of the apparatus related to the malfunction state, to self-restore the apparatus from the malfunction state, and a determination step of determining whether to shift to the self-restoration step, based on a result of the check operation. The apparatus works to further perform a measures output step of outputting information related to measures against an operation failure of a component in the apparatus, in which, in the determination step, it is determined whether to shift to the measures output step or shift to the self-restoration step, based on the result of the check operation.

19 Claims, 12 Drawing Sheets

(56) References Cited

U.S. PATENT DOCUMENTS

| | | | | |
|---|---|---|---|---|
| 2011/0201255 | A1* | 8/2011 | Tanaka | B24B 13/0055 451/5 |
| 2014/0297016 | A1 | 10/2014 | Yamamoto et al. | |

FOREIGN PATENT DOCUMENTS

| | | | | |
|---|---|---|---|---|
| JP | 2021-24055 | A | 2/2021 | |
| KR | 10-2018-0009608 | A | 1/2018 | |
| WO | WO-2014073465 | A1 * | 5/2014 | B24B 9/148 |
| WO | WO-2014091884 | A1 * | 6/2014 | B24B 47/225 |

* cited by examiner

NON-TRANSITORY COMPUTER-READABLE STORAGE MEDIUM, METHOD OF MANAGING EYEGLASSES LENS MACHINING APPARATUS, AND EYEGLASSES LENS MACHINING APPARATUS

CROSS-REFERENCE TO RELATED APPLICATION

This application claims priority from Japanese Patent Application No. 2022-058806 filed on Mar. 31, 2022, the entire subject-matter of which is incorporated herein by reference.

TECHNICAL FIELD

The present disclosure relates to a non-transitory computer-readable storage medium storing a management program of an eyeglasses lens machining apparatus that machines an eyeglasses lens, a method of managing the eyeglasses lens machining apparatus, and the eyeglasses lens machining apparatus.

BACKGROUND

An eyeglasses lens machining apparatus that machines an eyeglasses lens is widely used in an eyeglasses lens shop and the like. In such a type of the apparatus, a peripheral edge of the eyeglasses lens held by a lens holding shaft is machined by a machining tool. In the eyeglasses lens machining apparatus, when the apparatus is manufactured, when the apparatus is installed, and the like, calibration of a machining mechanism unit is performed such that finished shapes of the eyeglasses lens, such as an external size of the eyeglasses lens, an axial angle of the eyeglasses lens, a bevel position, and the like are appropriate (see JP2011-073134A, for example).

By the way, in a case where a malfunction occurs in an operation of an eyeglasses lens machining apparatus, an expert who has a thorough knowledge of the eyeglasses lens machining apparatus can check a cause of the occurrence of the malfunction to take appropriate measures. However, in the current situation, it is difficult to take appropriate measures against the malfunction of the operation of the eyeglasses lens machining apparatus unless the expert is involved.

SUMMARY

An object of the present disclosure is to provide a non-transitory computer-readable storage medium storing a management program of an eyeglasses lens machining apparatus, a method of managing the eyeglasses lens machining apparatus, and the eyeglasses lens machining apparatus which can take appropriate measures against a malfunction even in a case where the malfunction occurs in the operation of the eyeglasses lens machining apparatus.

A non-transitory computer-readable storage medium storing a management program of an eyeglasses lens machining apparatus including a controller configured to control the eyeglasses lens machining apparatus, the management program including instructions which, when executed by the controller, cause the eyeglasses lens machining apparatus to perform:

a check operation implementation step of causing the eyeglasses lens machining apparatus to implement a check operation for checking a malfunction state of an operation of the eyeglasses lens machining apparatus;

a self-restoration step of updating a calibration state of the eyeglasses lens machining apparatus related to the malfunction state, to self-restore the eyeglasses lens machining apparatus from the malfunction state; and a determination step of determining whether to shift to the self-restoration step, based on a result of the check operation.

An eyeglasses lens machining apparatus including a controller configured to execute the management program stored in the non-transitory computer-readable storage medium.

A method of managing an eyeglasses lens machining apparatus including a controller configured to perform the method including:

a check operation implementation step of causing the eyeglasses lens machining apparatus to implement a check operation for checking a malfunction state of an operation of the eyeglasses lens machining apparatus;

a self-restoration step of updating a calibration state of the eyeglasses lens machining apparatus related to the malfunction state, to self-restore the eyeglasses lens machining apparatus from the malfunction state; and a determination step of determining whether to shift to the self-restoration step, based on a result of the check operation.

DETAILED DESCRIPTION

Figure 1:
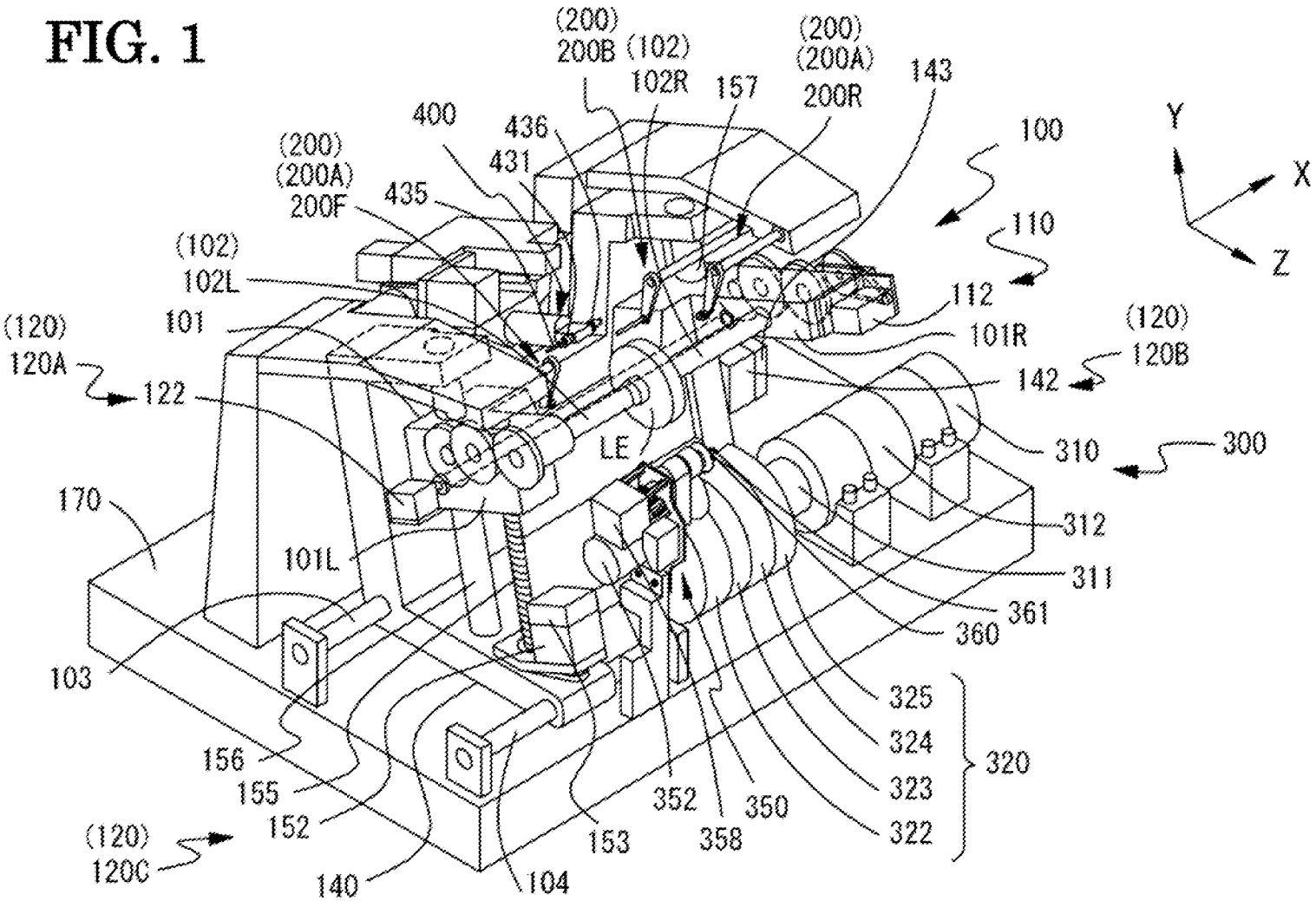
FIG. 1 is a diagram describing a configuration of a machining mechanism unit in an eyeglasses lens machining apparatus according to an example.

Hereinafter, one exemplary embodiment will be described with reference to the drawings. It should be noted that the items classified by < > below can be used independently or in association with each other.

<Overview>

<Eyeglasses Lens Machining Apparatus>

An eyeglasses lens machining apparatus (for example, an eyeglasses lens machining apparatus 1) according to the present disclosure machines a peripheral edge of an eyeglasses lens with a machining tool (for example, a machining tool 320, a chamfering tool 360, and a grooving tool 436). For example, the eyeglasses lens machining apparatus includes lens holding shafts (for example, lens holding shafts 102). The lens holding shafts interpose and hold the eyeglasses lens.

For example, the eyeglasses lens machining apparatus may include movement means (for example, a movement unit 120). For example, the movement means changes a relative positional relationship between the eyeglasses lens and the machining tool. For example, the movement means may include rotation means (for example, a lens rotation unit 120A) that rotates the lens holding shafts around an axis. For example, the movement means may include first movement means (for example, a first movement unit 120B) for changing a positional relationship between the eyeglasses lens and the machining tool in an axial direction (for example, an X direction) of the lens holding shafts. For example, the movement means may include second movement means (for example, a second movement unit 120C) for changing a positional relationship between the eyeglasses lens and the machining tool in a direction (for example, a Y direction) in which an inter-shaft distance between the lens holding shafts and a rotation shaft of the machining tool is changed.

For example, the eyeglasses lens machining apparatus may include lens shape measurement means (for example, a lens shape measurement unit 200). For example, the lens shape measurement means may include lens refractive surface shape measurement means (for example, a lens refractive surface shape measurement unit 200A). For example, the lens refractive surface shape measurement means has a tracing stylus (for example, a tracing stylus 206F and a tracing stylus 206R) that contacts a front refractive surface and a rear refractive surface of the eyeglasses lens, and is used to measure shapes of the front refractive surface and the rear refractive surface of the eyeglasses lens. For example, the lens shape measurement means may include lens external shape measurement means (for example, a lens external shape measurement unit 200B). For example, the lens external shape measurement means has a (for example, a tracing stylus 520) that contacts the peripheral edge of the eyeglasses lens, and is used to measure an external shape of the eyeglasses lens.

<Management Program>

A management program of the eyeglasses lens machining apparatus according to the present disclosure is a management program executed by a controller (for example, a controller 50) that controls the eyeglasses lens machining apparatus, and causes the controller to execute a check operation implementation step, a self-restoration step, and a determination step. For example, in the check operation implementation step, the eyeglasses lens machining apparatus is caused to execute a check operation for checking a malfunction state of an operation of the eyeglasses lens machining apparatus. For example, in the self-restoration step, a calibration state of the eyeglasses lens machining apparatus related to the malfunction state is updated to self-restore the eyeglasses lens machining apparatus from the malfunction state. For example, in the determination step, it is determined to shift to the self-restoration step, based on a result of the check operation in the check operation implementation step. As a result, it is possible to appropriately manage a state of the eyeglasses lens machining apparatus, and it is possible to take appropriate measures against the malfunction even in a case where a malfunction occurs in the operation of the eyeglasses lens machining apparatus.

For example, the management program may cause the controller to further execute a measures output step of outputting information related to measures against an operation failure of a component (for example, motors 112, 122, 142, 152, 216F, 216R, and 510, and origin sensors 114, 124, 144, 154, 224F, 224R, and 514) of the eyeglasses lens machining apparatus. In this case, for example, in the determination step, it is determined whether to shift to the measures output step or shift to the self-restoration step, based on the result of the check operation, in the check operation implementation step. For example, in the measures output step, as the information related to the measures against the operation failure, information indicating that the measures against the operation failure is necessary is output. For example, as the information indicating that measures is necessary to be taken, information prompting any of replacement of faulty parts, cleaning, and inspection is output. By informing an expert who has a thorough knowledge of the eyeglasses lens machining apparatus about the information indicating that the measures against the operation failure is necessary to be taken, it is facilitated to take appropriate measures against the malfunction of the eyeglasses lens machining apparatus.

For example, the management program may cause the controller to further perform a failure check step of checking whether or not the operation failure of the component occurs in the eyeglasses lens machining apparatus, based on the acquired information related to the result of the check operation in the check operation implementation step. In this case, in the determination step, it is determined to shift to the measures output step, in a case where it is confirmed that the operation failure of the component occurs in the eyeglasses lens machining apparatus in the failure check step.

For example, the management program may cause the controller to further perform a calibration check step of checking the calibration state of the eyeglasses lens machining apparatus related to the malfunction state, in a case where it is confirmed that no failure of the component occurs in the eyeglasses lens machining apparatus in the failure check step. In this case, in the determination step, it is determined that the shift to the self-restoration step is unnecessary, in a case where it is confirmed that the calibration state is normal in the calibration check step. For example, in the calibration check step, a calibration lens is machined by the machining tool based on a calibration target lens shape (for example, a calibration target lens shape 700). For example, in the calibration check step, a calibration item (for example, an external size of the eyeglasses lens, a bevel position of the eyeglasses lens in a direction along the lens holding shafts, and an axial angle of the eyeglasses lens) is selected according to a content of the operation failure information checked in the operation check control processing, and the shape of the eyeglasses lens after machining also based on the calibration target lens shape is compared with the calibration target lens shape, so that the calibration state of the selected calibration item is checked. For example, in the calibration check step, in a case where a difference between the shape of the eyeglasses lens after machining also based on the calibration target lens shape and the calibration target lens shape is within a predetermined tolerance value, it is determined that the calibration state is normal.

For example, in the determination step, a restoration information output step of outputting information related to the self-restoration may be performed, in a case where it is confirmed that the calibration state is faulty (not normal) in the calibration check step. In this case, for example, information for inquiring of an operator whether or not to update the calibration state may be included in the information related to the self-restoration output in the restoration information output step. In this case, for example, in the determination step, it may be determined to shift to the self-restoration step in a case where the operator gives permission to update the calibration state. Of course, in the restoration information output step, the inquiry to the operator as to whether or not to update the calibration state may be omitted, and it may be directly determined to shift to the self-restoration step, in a case where it is confirmed that the calibration state is faulty (not normal) in the calibration check step. In this case, the information related to the self-restoration includes update data for updating the calibration state. For example, the update data is obtained by calculating the difference between the shape of the eyeglasses lens after machining based on the calibration target lens shape and the calibration target lens shape.

In a case where it is determined to shift to the self-restoration step, self-restoration processing is performed by updating the calibration state of each unit (calibration item) of the eyeglasses lens machining apparatus based on the update data. As a result, even in a case where the expert who has a thorough knowledge of the eyeglasses lens machining apparatus cannot be involved, appropriate measures is taken against the malfunction of the operation of the eyeglasses lens machining apparatus.

For example, the check operation implemented in the check operation execution step may include at least one of a check operation for a malfunction in the direction along the lens holding shafts that interpose and hold the eyeglasses lens, a check operation for a malfunction in a direction orthogonal to the lens holding shafts, and a check operation for a malfunction in a direction in which the lens holding shafts are rotated. These check operations may be implemented singly or in combination. For example, the check operation in the direction along the lens holding shafts includes an operation check of a motor that moves the eyeglasses lens in the direction along the lens holding shafts. For example, the check operation in the direction orthogonal to the lens holding shafts includes an operation check of a motor that moves the eyeglasses lens in the direction orthogonal to the lens holding shafts. For example, the check operation in the direction in which the lens holding shafts are rotated includes an operation check of a motor that rotates the eyeglasses lens.

For example, in the check operation implementation step, an operation failure information acquisition step may be further performed. In the operation failure information acquisition step, operation failure information indicating a content that the operation is unnecessary in the eyeglasses lens machining apparatus is acquired. In the operation check implementation step, a check operation for checking a cause of the operation failure indicated by the acquired operation failure information may be implemented. In this case, the cause of the operation failure of the eyeglasses lens machining apparatus (for example, an operation failure that actually occurs in the eyeglasses lens machining apparatus, and an operation failure that has a possibility of occurring in the eyeglasses lens machining apparatus) is appropriately checked based on the result of the check operation.

For example, in the check operation implementation step, among a plurality of check operations, one or a plurality of check operations associated with the acquired operation failure information (that is, corresponding to the content (type) of the operation failure indicated by the operation failure information) may be implemented by the eyeglasses lens machining apparatus. In this case, unlike a simple case where only the information of the error is output, the check operation corresponding to the content of the operation failure is implemented by the eyeglasses lens machining apparatus, and information indicating the result of the check operation is output. Therefore, it is facilitated to estimate the cause of the operation failure, based on the result of the check operation.

For example, in a case where the eyeglasses lens machining apparatus detects the operation failure that occurs in the apparatus, in the operation failure information acquisition step, the operation failure information indicating the content of the detected operation failure may be acquired. In this case, the content of the check operation to be implemented by the eyeglasses lens machining apparatus is automatically selected according to the content of the operation failure detected by the eyeglasses lens machining apparatus. Therefore, the cause of the detected operation failure is estimated more appropriately.

For example, in the operation failure information acquisition step, the operation failure information input by the operator (user) may be acquired. In this case, for example, even in a case where the operation failure is not detected by the eyeglasses lens machining apparatus, the operator can self-check the workmanship of the actually machined eyeglasses lens to cause the eyeglasses lens machining apparatus to appropriately execute the check operation for checking the cause of the operation failure that occurs.

It should be noted that the present disclosure is not limited to the apparatus described in the present example. For example, the management program (software) of the eyeglasses lens machining apparatus that executes the functions of the embodiment is supplied to a system or the eyeglasses lens machining apparatus via a network or various storage media. Then, the system or the controller (for example, a CPU) of the eyeglasses lens machining apparatus can read out program and execute the program.

<Management Method>

For example, a management method of the eyeglasses lens machining apparatus according to the present disclosure is a management method implemented by the controller that controls the eyeglasses lens machining apparatus, and includes the check operation implementation step, the self-restoration step, and the determination step. For example, in the check operation implementation step, the eyeglasses lens machining apparatus is caused to execute the check operation for checking the malfunction state of the operation of the eyeglasses lens machining apparatus. For example, in the self-restoration step, the calibration state of the eyeglasses lens machining apparatus related to the malfunction state is updated to self-restore the eyeglasses lens machining apparatus from the malfunction state. For example, in the determination step, it is determined to shift to the self-restoration step, based on the result of the check operation in the check operation implementation step. As a result, it is possible to appropriately manage the state of the eyeglasses lens machining apparatus, and it is possible to take appropriate measures against the malfunction even in a case where the malfunction occurs in the operation of the eyeglasses lens machining apparatus.

For example, the management method of the eyeglasses lens machining apparatus may further include the measures output step of outputting the information related to the measures against the operation failure of the component in the eyeglasses lens machining apparatus. In this case, for example, in the determination step, it is determined whether to shift to the measures output step or shift to the self-restoration step, based on the result of the check operation.

For example, the management method of the eyeglasses lens machining apparatus may include the failure check step of checking whether or not the operation failure of the component occurs in the eyeglasses lens machining apparatus, based on the acquired information related to the result of the check operation in the check operation implementation step. In this case, in the determination step, it is determined to shift to the measures output step, in a case where it is confirmed that the operation failure of the component occurs in the eyeglasses lens machining apparatus in the failure check step.

For example, the management method of the eyeglasses lens machining apparatus may further include the calibration check step of checking the calibration state of the eyeglasses lens machining apparatus related to the malfunction state, in a case where it is confirmed that no failure of the component occurs in the eyeglasses lens machining apparatus in the failure check step. In this case, in the determination step, it is determined that the shift to the self-restoration step is unnecessary, in a case where it is confirmed that the calibration state is normal in the calibration check step.

For example, in the determination step of the management method, the restoration information output step of outputting information related to the self-restoration may be included, in a case where it is confirmed that the calibration state is faulty in the calibration check step. In this case, for example, in the determination step, it may be determined to shift to the self-restoration step in a case where the operator gives the permission to update the calibration state.

For example, the check operation implemented in the check operation implementation step of the management method may include at least one of the check operation for the malfunction in the direction along the lens holding shafts that interpose and hold the eyeglasses lens, the check operation for the malfunction in the direction orthogonal to the lens holding shafts, and the check operation for the malfunction in the direction in which the lens holding shafts are rotated. These check operations may be implemented singly or in combination.

EXAMPLE

One exemplary example of the present disclosure will be described with reference to the drawings. FIG. 1 is a diagram describing a configuration of a machining mechanism unit in the eyeglasses lens machining apparatus 1 according to the example. It should be noted that the eyeglasses lens machining apparatus 1 according to the example also serves as a controller that controls various operations and processing, such as machining operations. However, a controller (for example, a personal computer) that controls the eyeglasses lens machining apparatus 1 may be used separately from the eyeglasses lens machining apparatus 1.

The eyeglasses lens machining apparatus 1 according to the example includes a lens holding unit 100. The lens holding unit 100 includes the lens holding shafts 102 (lens chuck shafts) that hold the eyeglasses lens (hereinafter, referred to as a lens LE) that is a machined lens. For example, the lens holding shafts 102 include two lens holding shafts (lens chuck shafts) 102R and 102L for interposing and holding the lens LE.

The eyeglasses lens machining apparatus 1 includes the lens shape measurement unit 200. The lens shape measurement unit 200 includes the lens refractive surface shape measurement unit 200A and the lens external shape measurement unit 200B.

The eyeglasses lens machining apparatus 1 includes a first machining tool unit 300. The first machining tool unit 300 includes the machining tool 320 for machining the peripheral edge of the lens LE. The eyeglasses lens machining apparatus 1 may include a second machining tool unit 350. The second machining tool unit 350 includes, for example, a chamfering tool 360. The eyeglasses lens machining apparatus 1 may include the second machining tool unit 400. The second machining tool unit 400 includes, for example, a drilling tool 435 for drilling the refractive surface of the lens LE, and the grooving tool 436 for forming a groove in the peripheral edge of the lens LE.

The eyeglasses lens machining apparatus 1 includes a lens chuck unit 110 for holding the lens LE with the two lens holding shafts 102R and 102L. For example, the lens chuck unit 110 holds the lens LE with the two lens holding shafts 102R and 102L by moving the lens holding shaft 102R to the lens holding shaft 102L side.

The eyeglasses lens machining apparatus 1 includes the movement unit 120 that is an example of the movement means for changing (adjusting) a relative positional relationship between the lens LE held by the lens holding shafts 102 and the machining tool 320. The movement unit 120 includes the lens rotation unit 120A, the first movement unit 120B, and the second movement unit 120C.

The lens rotation unit 120A is configured to rotate a pair of the lens holding shafts 102 around an axis. The first movement unit 120B is configured to change a positional relationship between the lens LE and the machining tool 320 in an axial direction (referred to as the X direction) of the lens holding shafts 102. The second movement unit 120C is configured to change a positional relationship between the lens LE and the machining tool 320 in a direction (referred to as the Y direction) in which the inter-shaft distance between the lens holding shafts 102 and a rotation shaft 361 of the machining tool 320 is changed. The movement unit 120 is also used to change a relative positional relationship between the lens LE and the chamfering tool 360 of the second machining tool unit 350. The movement unit 120 is also used to change a relative positional relationship between the lens LE and the machining tools 435 and 436 of the third machining tool unit 400. The movement unit 120 is also used when the lens shape measurement unit 200 measures a refractive surface shape and a lens external shape of the lens LE.

Hereinafter, a specific example of each configuration in the eyeglasses lens machining apparatus 1 will be described in detail. The lens holding unit 100 is mounted on a base 170 of a body of the eyeglasses lens machining apparatus 1.

<Lens Rotation Unit>

The lens rotation unit 120A will be described. The lens holding shaft 102R is rotatably held by a right arm 101R of a carriage 101 of the lens holding unit 100, and the lens holding shaft 102L is rotatably held by a left arm 101L of the carriage 101. In addition, the lens holding shaft 102R and the lens holding shaft 102L are coaxially held by the right arm 101R and the left arm 101L, respectively. The two lens holding shafts 102R and 102L are synchronously rotated by a motor 122 attached to the left arm 101L via a rotation transmission mechanism, such as a gear. The origin sensor 124 (see FIG. 5) for detecting an origin position of the rotation of the lens holding shafts 102 is disposed in a rotation mechanism of the lens holding shafts 102.

<Chuck Unit>

The chuck unit 110 includes the motor 112 attached to the right arm 101R. The lens holding shaft 102R is moved by the motor 112 to the lens holding shaft 102L side. As a result, the lens LE is interposed and held between the two lens holding shafts 102R and 102L. The chuck unit 110 includes the origin sensor 114 (see FIG. 5) for detecting the origin position of the movement of the lens holding shaft 102R.

<First Movement Unit>

The first movement unit 120B will be described. An X-axis movement support base 140 is provided on shafts 103 and 104 extending parallel to the lens holding shafts 102 and the machining tool rotation shaft 361. The X-axis movement support base 140 can move in an X-axis direction along the shafts 103 and 104 by power of the motor 142 for X-axis movement. The carriage 101 is mounted on the X-axis movement support base 140. An encoder 143 is provided on the rotation shaft of the motor 142 for X-axis movement. The encoder 143 detects the positions of the lens holding shafts 102 (that is, the lens LE) with respect to the origin position in the X direction. Also, the first movement unit 120B includes the origin sensor 144 (see FIG. 5) for detecting the origin position of the movement of the lens holding shafts 102 in the X direction.

<Second Movement Unit>

The second movement unit 120C will be described. Two shafts 156 and 157 extending in the Y direction are fixed to the X-axis movement support base 140. In a case where the motor 152 for Y-axis movement rotates, a ball screw 155 extending in the Y direction rotates. As a result, the left arm 101L and the right arm 101R (that is, the lens holding shafts 102) of the carriage 101 move along the shafts 156 and 157 in the Y direction. The rotation shaft of the motor 152 for Y-axis movement is provided with an encoder 153 that detects the positions of the lens holding shafts 102 with respect to the origin position in the Y direction. Also, the second movement unit 120C includes the origin sensor 154 (see FIG. 5) for detecting the origin position of the movement in the Y direction.

<First Machining Tool Unit>

The first machining tool unit 300 includes a motor 310 for rotating a machining tool rotation shaft 311. The machining tool rotation shaft 311 is rotatably held by a rotation shaft holding unit 312 in a parallel positional relationship with the lens holding shafts 102. The rotation shaft holding unit 312 is attached to the base 170. The machining tool 320 for machining the peripheral edge of the lens LE is provided on the machining tool rotation shaft 311. For example, the machining tool 320 includes at least one of a rough grindstone 322, a finishing grindstone 323 of a high curve lens, a finishing grindstone 324 of a low curve lens, and a polish-finishing grindstone 325. The finishing grindstone 324 has a V-groove (bevel groove) for forming a bevel and a flat machining surface. The finishing grindstone 323 has a front bevel machining surface for forming a front bevel on the lens LE and a rear bevel machining surface for forming a rear bevel on the lens LE. A cutter may be used as the machining tool 320. The peripheral edge of the lens LE held by the lens holding shafts 102 is pressure-welded by the machining tool 320 and machined.

<Second Machining Tool Unit>

The second machining tool unit 350 is disposed on the first machining tool unit 300 side with respect to the carriage 101. The chamfering tool 360 is attached to the machining tool rotation shaft 361. The chamfering tool 360 has a machining surface for a lens front surface and a machining surface for a lens rear surface. For example, the chamfering tool 360 is configured by a grindstone, but may be a cutter. The machining tool rotation shaft 361 is rotated by a motor 352 via a rotation transmission mechanism inside an arm 354. Also, the machining tool rotation shaft 361 is moved from a retract position to a predetermined machining position by a motor 358. It should be noted that since the technology disclosed in JP2011-73134A can be employed for the configuration of the second machining tool unit 350, the details can be referred thereto.

<Third Machining Tool Unit>

The third machining tool unit 400 is disposed on an opposite side of the carriage 101 with respect to the first machining tool unit 300. The second machining tool unit 400 includes a drilling tool 435 and the grooving tool 436 as the machining tools. The drilling tool 435 and the grooving tool 436 are attached to a machining tool rotation shaft 431. The machining tool rotation shaft 431 is rotated by a motor 432 (see FIG. 5). The machining tool rotation shaft 431 is moved back and forth in a Z direction orthogonal to the X direction and the Y direction by a motor 405 (see FIG. 5). By driving the motor 405, the drilling tool 435 and the grooving tool 436 are moved from the retract position to a machining possible position. In addition, the machining tool rotation shaft 431 is rotated around an axis extending in the Z direction by a motor 416 (see FIG. 5). As a result, an angle in the axial direction of the machining tool rotation shaft 431 with respect to the lens holding shafts 102 can be optionally changed. Therefore, when the drilling tool 435 drills the refractive surface of the lens LE, an angle of a hole direction can be changed. Since the technology disclosed in JP2011-73134A can be employed for the configuration of the third machining tool unit 350, the details can be referred thereto.

<Lens Refractive Surface Shape Measurement Unit>

The lens refractive surface shape measurement unit 200A is disposed above the carriage 101. The lens refractive surface shape measurement unit 200A is used to acquire the shape of the front refractive surface (lens front surface) of the lens LE and the shape of the rear refractive surface (lens rear surface). For example, the lens refractive surface shape measurement unit 200A includes a lens edge position measurement unit 200F for measuring an edge position of the front refractive surface of the lens LE, and a lens edge position measurement unit 200R for measuring an edge position of the rear refractive surface of the lens LE. The lens refractive surface shape measurement unit 200A functions as a lens thickness measurement unit that measures a thickness of the eyeglasses lens.

Figure 2:
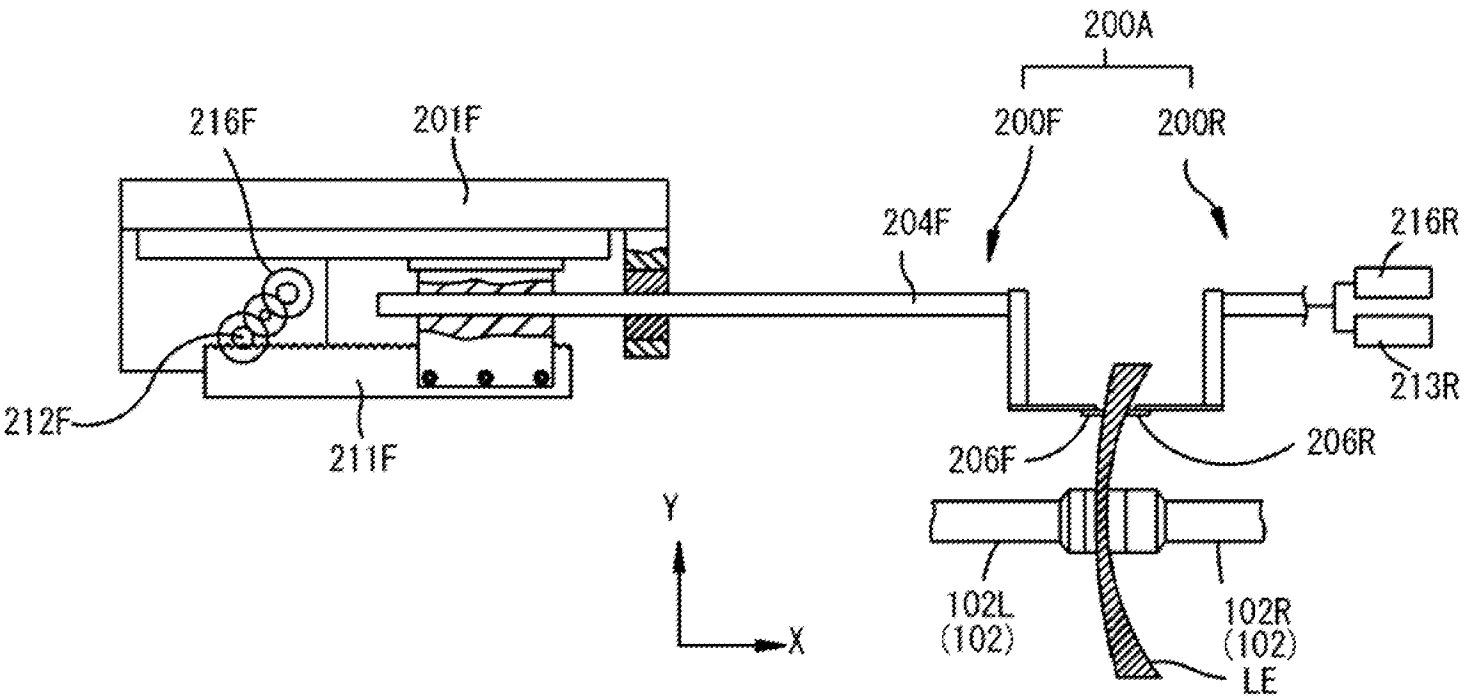
FIG. 2 is a schematic configuration diagram of a lens edge position measurement unit.

FIG. 2 is a schematic configuration diagram of the lens edge position measurement unit 200F. The lens edge position measurement unit 200F includes the tracing stylus 206F that contacts the front refractive surface of the lens LE. The lens edge position measurement unit 200F includes a detector 213F, which is an example of detection means for detecting a position of the tracing stylus 206F in the axial direction (X direction) of the lens holding shafts 102. The tracing stylus 206F is attached to a distal end of an arm 204F. The arm 204F is held by an attachment support base 201F to be movable in the X direction. The arm 204F is connected to the motor 216F via a rotation transmission mechanism, such as a rack 211F. The arm 204F is moved in the X direction by driving the motor 216F, and the tracing stylus 206F is pressed against the front refractive surface of the lens LE. A pinion 212F is attached to a rotation shaft of the detector 213F (for example, an encoder). The detector 213 detects the position of the tracing stylus 206F moved in the X direction. Also, the lens edge position measurement unit 200F includes the origin sensor 224F (see FIG. 5) for detecting an origin position of the movement of the tracing stylus 206F in the X direction.

Since the configuration of the lens edge position measurement unit 200R is bilaterally symmetrical with the lens edge position measurement unit 200F, the description thereof will be omitted. The lens edge position measurement unit 200R includes the tracing stylus 206R that contacts the rear refractive surface, the motor 216R that moves the tracing stylus 206R in the X direction, a detector 213R that detects a position of the tracing stylus 206R in the X direction, and the origin sensor 224R (see FIG. 5).

<Lens External Shape Measurement Unit>

Figure 3A:
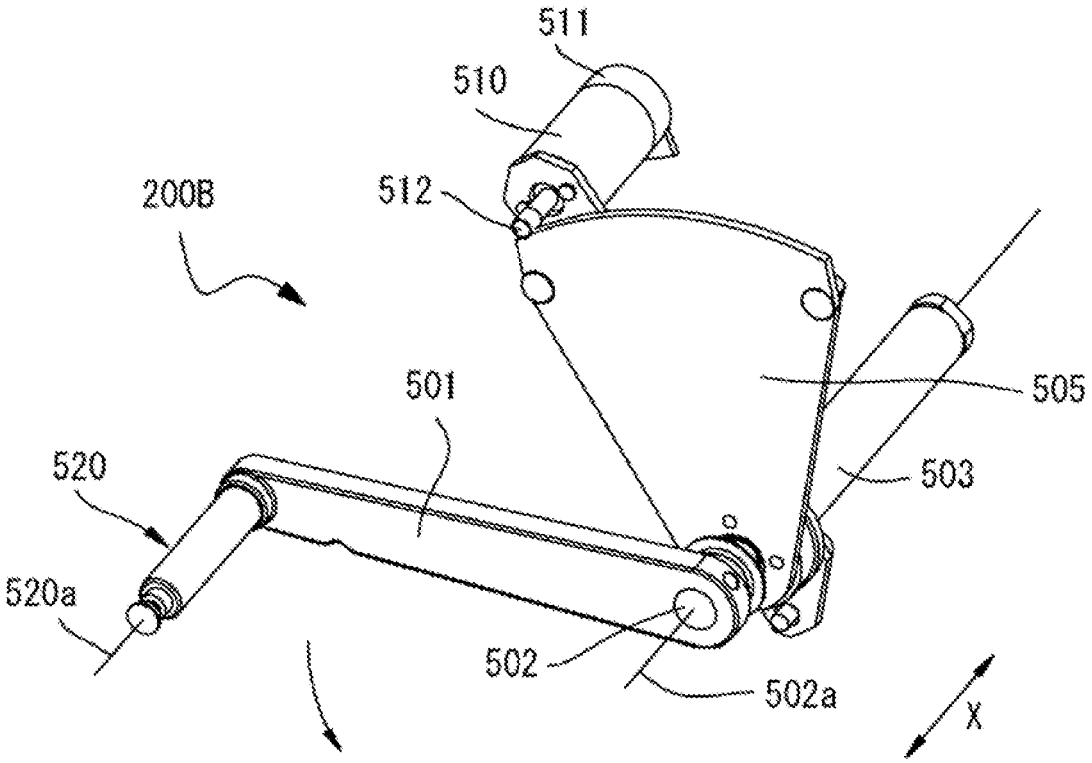
FIGS. 3A and 3B show diagrams describing a lens external shape measurement unit.
Figure 3B:
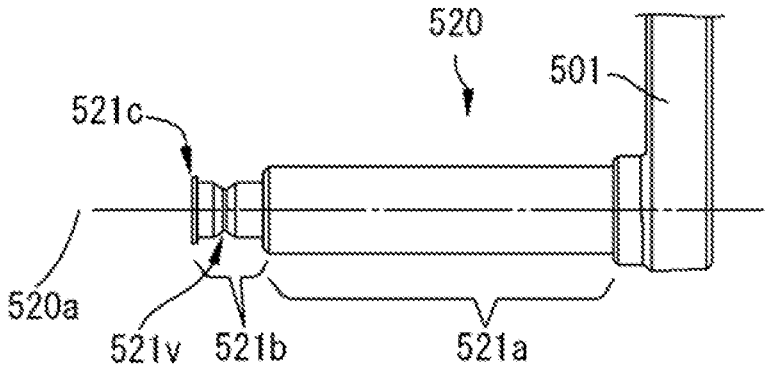

The lens external shape measurement unit 200B is disposed on an upper rear side on the lens holding shaft 102R side. FIGS. 3A and 3B show diagrams describing the lens external shape measurement unit 200B. FIG. 3A is a schematic configuration diagram of the lens external shape measurement unit 200B. FIG. 3B is a front view of the tracing stylus 520 of the lens external shape measurement unit 200B.

The cylindrical tracing stylus 520 that contacts an edge of the lens LE is fixed to one end of an arm 501, and a rotation shaft 502 is fixed to the other end of the arm 501. A central axis 520*a* of the tracing stylus 520 and a central axis 502*a* of the rotation shaft 502 are disposed in a parallel positional relationship with the lens holding shafts 102 (X direction). The rotation shaft 502 is held by a holding unit 503 to be rotatable around the central axis 502*a*. The holding unit 503 is fixed to a block 300*a* of FIG. 1. A fan-shaped gear 505 is fixed to the rotation shaft 502, and the gear 505 is rotated by the motor 510. An encoder 511 as a detector is attached to a rotation shaft of the motor 510. Also, the lens external shape measurement unit 200B includes the origin sensor 514 (see FIG. 5) for detecting an origin position of the tracing stylus 520 in a rotation direction.

The tracing stylus 520 has a cylindrical portion 521*a* that contacts when the external size of the lens LE is measured, a small-diameter cylindrical portion 521*b* including a V-groove 521*v* used when the bevel position (position of the bevel in the X direction) formed on the lens LE is measured, and a protrusion portion 521*c* used when a groove position (position of the groove in the X direction) formed on the lens LE is measured.

Figure 4:
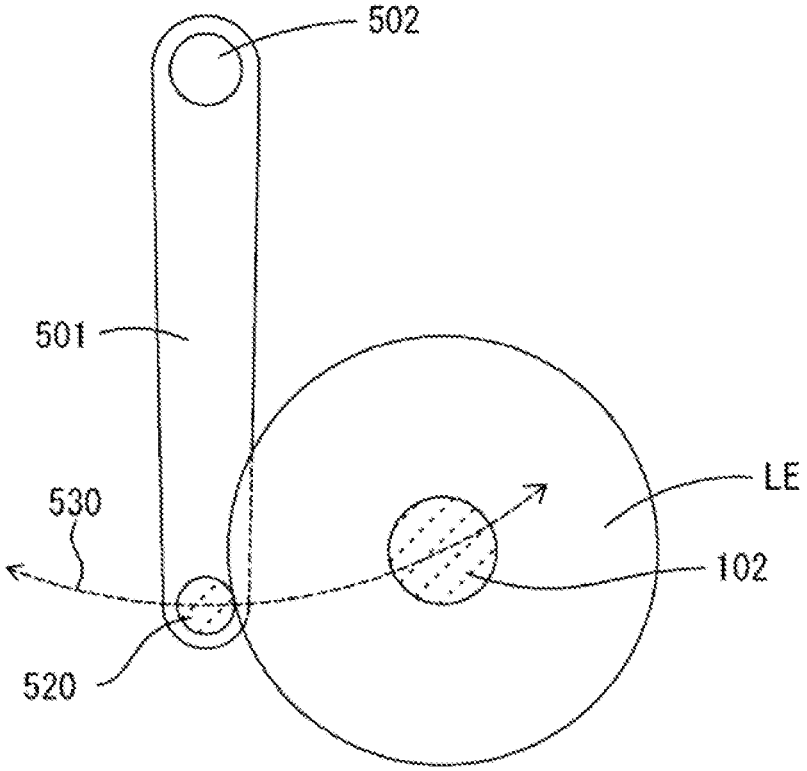
FIG. 4 is a diagram describing measurement of an external shape of an eyeglasses lens by the lens external shape measurement unit.

When the external shape of the lens LE is measured, as shown in FIG. 4, the lens holding shafts 102 are moved to a predetermined measurement position (on a movement path 530 of the central axis 520*a* of the tracing stylus 520 rotated around the rotation shaft 502). By rotating the arm 501 by the motor 510, the tracing stylus 520 placed at the retract position is moved to the lens LE side, and the cylindrical portion 521*a* of the tracing stylus 520 contacts the edge (peripheral edge) of the lens LE. The motor 510 applies a predetermined measurement pressure to the tracing stylus 520. Then, by rotating the lens LE once and detecting the movement of the tracing stylus 520 in this case by the encoder 511, the external shape of the lens LE centered on the lens holding shafts 102 is measured.

It should be noted that the lens external shape measurement unit 200B is configured by the rotation mechanism of the arm 501 as described above, and may also be a mechanism that linearly moves the tracing stylus 520 in the direction (Z direction) orthogonal to the X direction and the Y direction.

<Electric Configuration>

Figure 5:
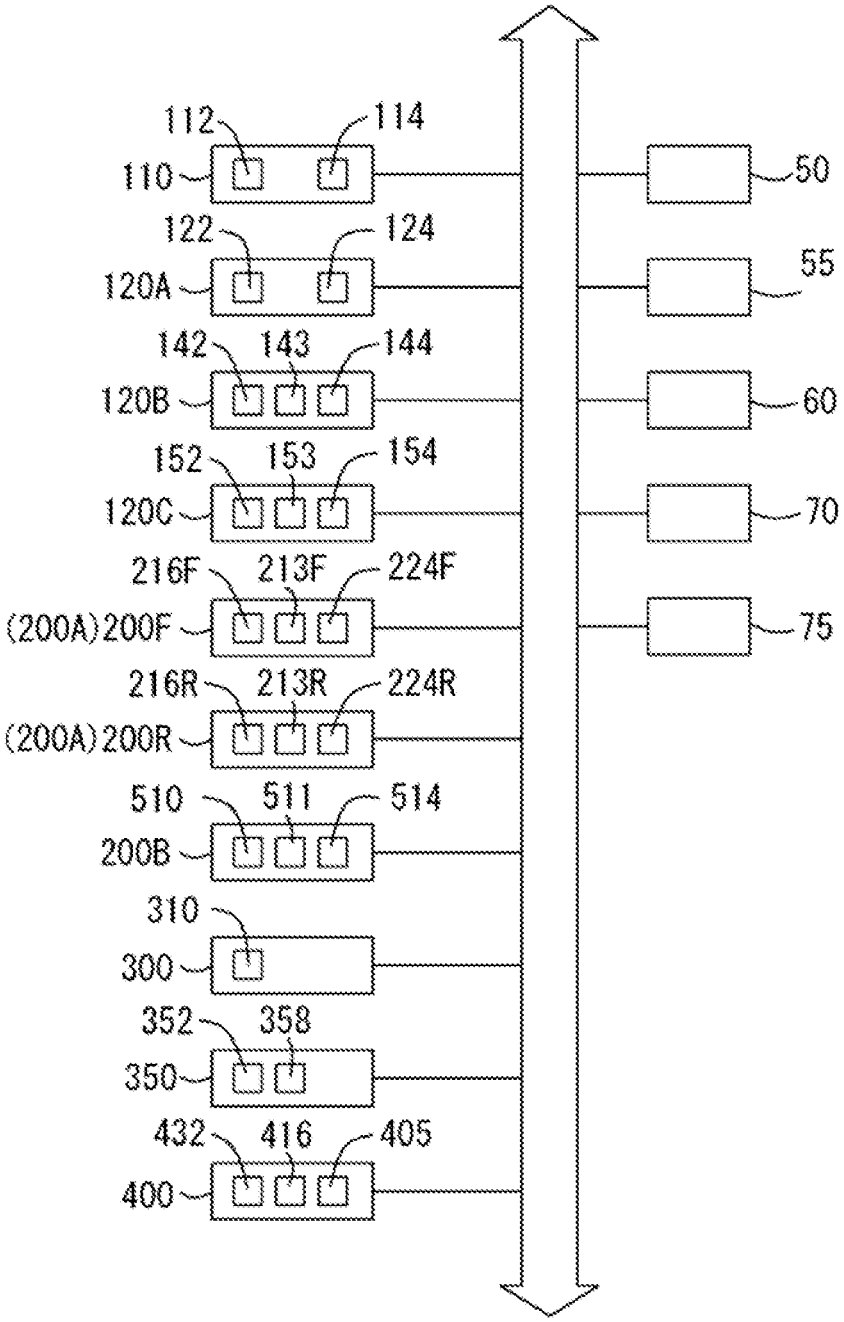
FIG. 5 is a diagram describing an electric configuration of the eyeglasses lens machining apparatus.

FIG. 5 is a diagram describing an electric configuration of the eyeglasses lens machining apparatus 1. The eyeglasses lens machining apparatus 1 includes the controller 50, which is an example of the controller that controls various operations and processing, such as machining operations. The controller 50 includes a CPU, a RAM, a ROM, a nonvolatile memory, and the like. Various devices, such as the motor, the encoder, and the origin sensor shown in FIG. 1, are connected to the controller 50 via a bus. An operation unit 55, a display unit 60, a storage unit 70 (for example, a non-transitory computer-readable storage medium), and an external communication interface (I/F) 75 are connected to the controller 50 via the bus. The operation unit 55 receives input of various instructions from the operator. As the display unit 60, a display having a touch panel function, for example, is used. In a case where the display is used as the display unit 60, a configuration may be adopted in which the operation unit 55 is provided. The storage unit 70 may store a control program for controlling the operation of the eyeglasses lens machining apparatus 1 (for example, a machining control program related to the machining of the lens LE, a state management program, and a management program of various processing) or the management program explained above. For example, the external communication I/F 75 may be connected to an external apparatus, such as a target lens shape measurement apparatus that acquires target lens shape data that is a machining target shape of the lens LE. Also, the controller 50 may also serve as output means for outputting various information.

<Operation>

Figure 6:
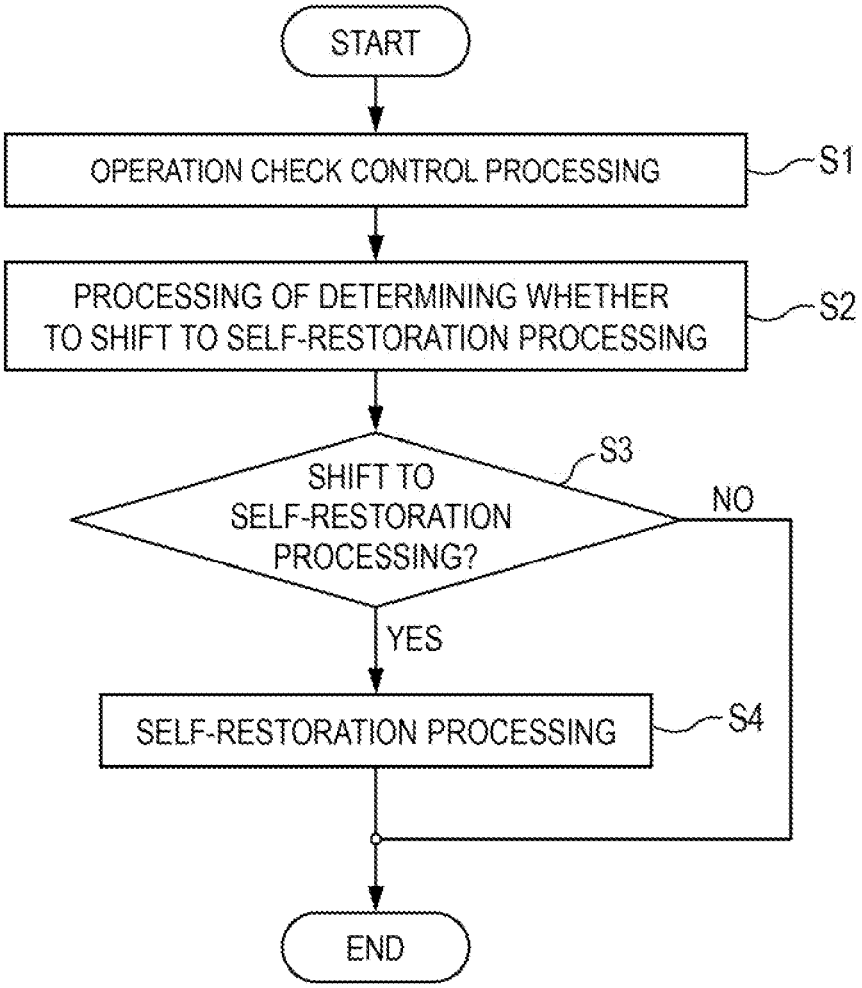
FIG. 6 is a flowchart of overall processing for malfunction of an operation of the eyeglasses lens machining apparatus.

The operation of the eyeglasses lens machining apparatus 1 having the configuration described above will be described. FIG. 6 is a flowchart of overall processing for the malfunction of the operation of the eyeglasses lens machining apparatus 1, which is implemented by the controller 50 of the eyeglasses lens machining apparatus 1.

In the overall processing for the measures, check operation control processing (S1) of checking the malfunction state of the operation of the eyeglasses lens machining apparatus 1, and determination processing (S2) of determining the shift to the self-restoration processing based on the result of the check operation in S1 are performed. It is determined whether or not to shift to the self-restoration processing by the determination processing in S2 (S3), and the shift to self-restoration processing (S4) of self-restoring the eyeglasses lens machining apparatus 1 from the malfunction state is performed in a case where it is determined to shift to the self-restoration processing. Hereinafter, each processing will be described.

<Operation Check Control Processing>

Figure 7A:
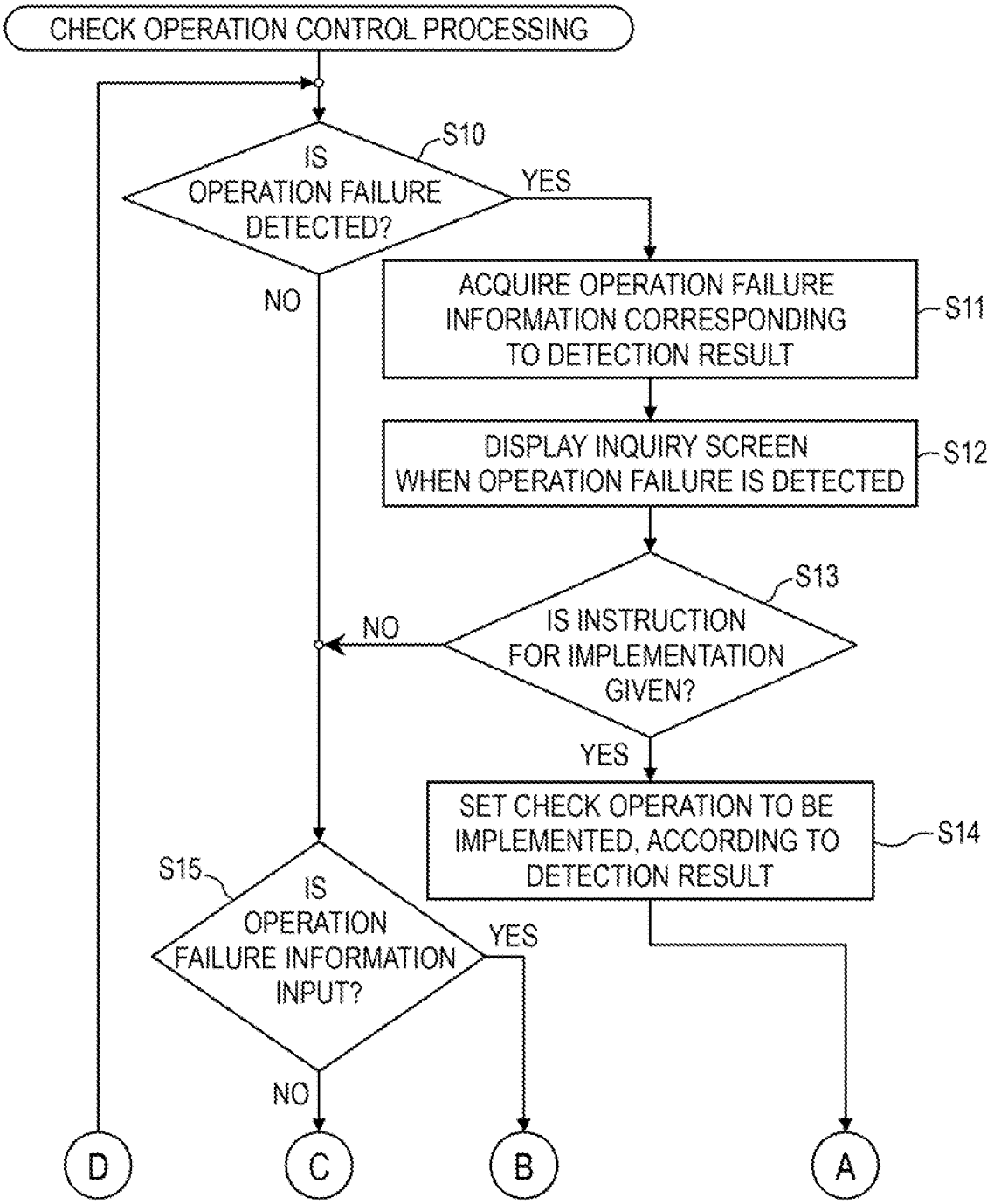
FIGS. 7A and 7B show a flowchart of check operation control processing.
Figure 7B:
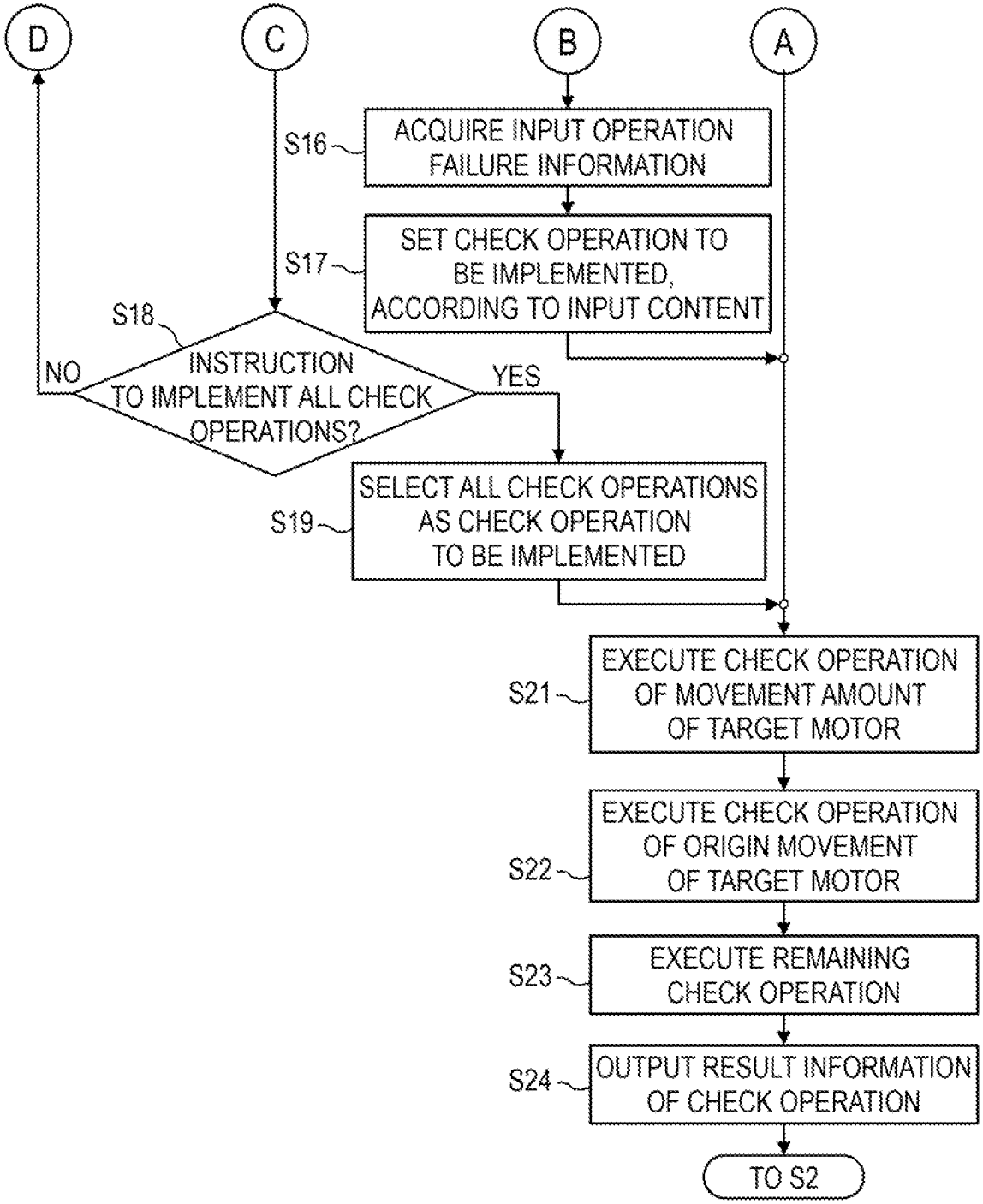

The check operation control processing (S1) performed by the controller 50 will be described with reference to FIGS. 7A and 7B. FIGS. 7A and 7B show a flowchart of the check operation control processing.

It should be noted that the check operation is an operation to be implemented by the eyeglasses lens machining apparatus 1 in order to check the malfunction state of the eyeglasses lens machining apparatus 1 with as high accuracy as possible. The malfunction state of the operation of the eyeglasses lens machining apparatus 1 includes the operation failure of the eyeglasses lens machining apparatus 1. The check operation according to the present example is implemented by the eyeglasses lens machining apparatus 1 in order to check the cause of the operation failure that has a possibility of occurring in the eyeglasses lens machining apparatus 1. More specifically, the check operation according to the present example is an operation (that is, a dedicated operation for state check) implemented separately from the operation (for example, at least any of a machining operation, a measurement operation, and communication operation) of the eyeglasses lens machining apparatus 1 that is actually necessary to be implemented in order to fit the lens LE into an eyeglasses frame. Specifically, a part of the plurality of check operations includes an operation of driving the plurality of motors (112, 122, 142, 152, 216F, 216R, and 510) in the state that the lens LE is not held by the lens holding shafts 102. Therefore, the cause of the operation failure is estimated more appropriately.

Figure 8:
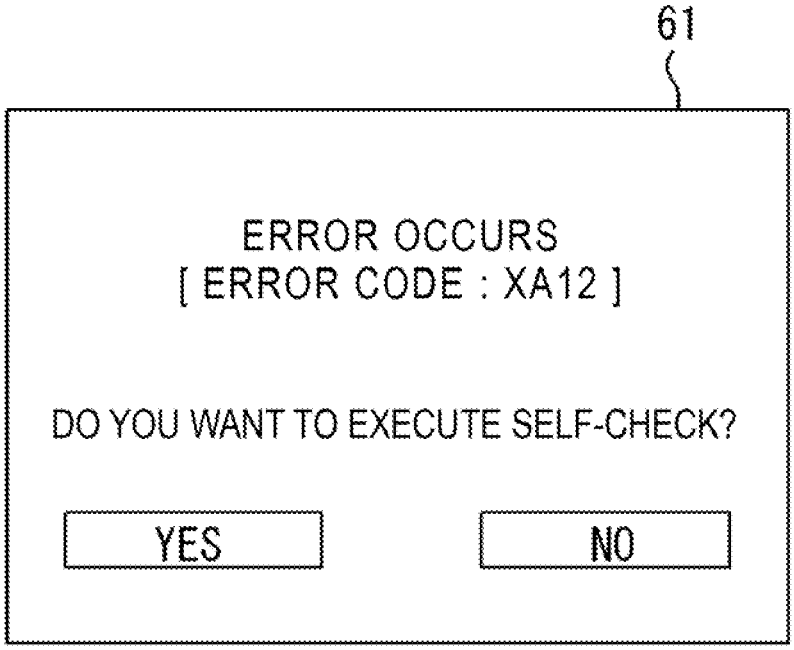
FIG. 8 is a diagram showing an example of an inquiry screen when an operation failure is detected.

The controller 50 determines whether or not the operation failure is detected in the eyeglasses lens machining apparatus 1 (for example, whether or not the error occurs) (S10). The controller 50 can detect the operation failure that occurs in the eyeglasses lens machining apparatus 1 based on signals from various actuators, such as motors, sensors, and the like. In a case where the operation failure is detected (S10: YES), the controller 50 acquires the operation failure information (for example, an error code) indicating a content of the detected operation failure (S11). The controller 50 notifies the operator (user) that the operation failure (error) occurs, and inquires of the operator whether or not to cause the eyeglasses lens machining apparatus 1 to execute the check operation. As an example, in the present example, as shown in FIG. 8, the controller 50 displays an inquiry screen 61 when the operation failure is detected, on the display unit 60 (S12). For example, a message for notifying the operator that the operation failure (error) occurs and the error code indicating the content of the operation failure are displayed on the inquiry screen when the operation failure is detected. Further, a message for inquiring of the operator (user) whether or not to execute the check operation (sometimes referred to as a "self-check") and "YES" and "NO" buttons are displayed on the inquiry screen when the operation failure is detected. The operator operates the "YES" button to execute the check operation, and the "NO" button to not execute the check operation. It should be noted that the error notification method and the like can be selected as appropriate. For example, the notification of the error may be given by voice.

In a case where an instruction not to implement the check operation is input (S13: NO), it is shifted to S15. In a case where an instruction to implement the check operation is input (S13: YES), the controller 50 selects the check operation for checking the cause of the detected operation failure as the check operation to be actually implemented. Specifically, the controller 50 selects one or a plurality of check operations associated with the operation failure information (that is, the content of the operation failure detected in S10) acquired in S11 among the plurality of check operations that can be implemented in the eyeglasses lens machining apparatus 1, as the check operation to be actually implemented (S14). Therefore, the check operation to be implemented by the eyeglasses lens machining apparatus 1 is automatically selected according to the content of the detected operation failure.

In a case where the operation failure is not detected (S10: NO), the controller 50 determines whether the operation failure information is input or not by the operator (S15). In the present example, for example, in a case where the malfunction occurs in the machining of the lens LE implemented by the eyeglasses lens machining apparatus 1, the operator can input the operation failure information, related to the malfunction of the machining occurred, to the eyeglasses lens machining apparatus 1 via the operation unit 55 or the like, and then execute an appropriate check operation.

In a case where the operation failure information is input (S15: YES), the controller 50 acquires the input operation failure information (S16). The controller 50 selects the check operation for checking the cause of the operation failure indicated by the input operation failure information as the check operation to be actually implemented. Specifically, the controller 50 selects one or a plurality of check operations associated with the input operation failure information among the plurality of check operations that can be implemented in the eyeglasses lens machining apparatus 1, as the check operation to be actually implemented (S17). The processing in S14 and S17 will be described in more detail. In the present example, the check operation to be implemented is associated in advance with the type of each operation failure information. Specifically, data (table data) in which each of a plurality of operation failure information is associated with the content of the check operation to be implemented by the eyeglasses lens machining apparatus 1 is stored in a database in advance. The controller 50 selects the check operation associated with the acquired operation failure information in the table data as the check operation to be actually implemented. It should be noted that the association of the type of each operation failure information with the check operation to be implemented is appropriately updated by an operator of a manufacturer or the like according to an analysis result of the cause of occurrence of the operation failure. Therefore, it is easy to execute an appropriate check operation according to the content of the operation failure that occurs.

Figure 9:
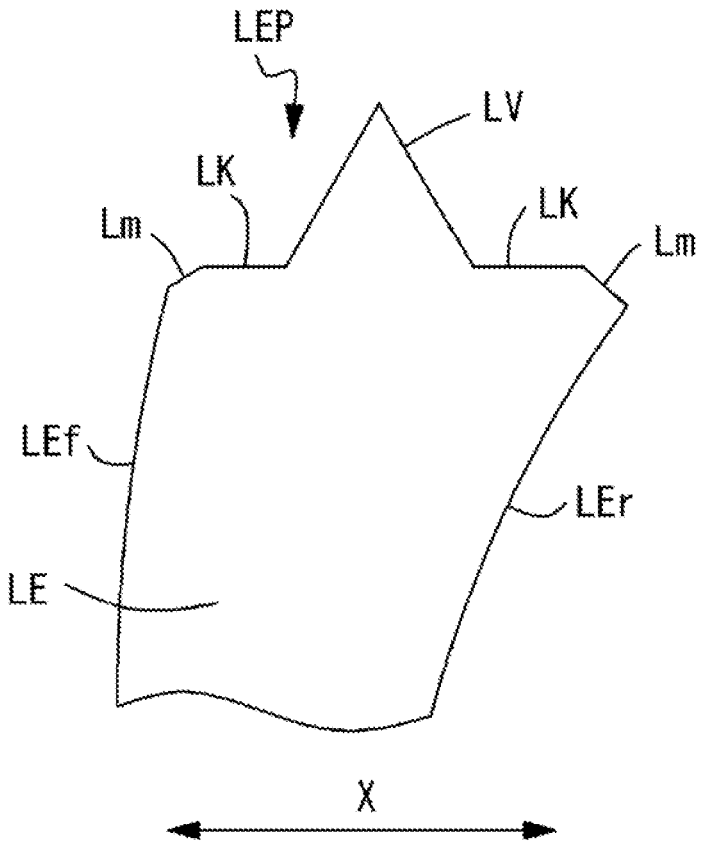
FIG. 9 is an enlarged cross-sectional view of an edge portion of a machined eyeglasses lens.

A specific example of a method of selecting the check operation to be actually implemented according to the content of operation failure information will be described with reference to FIG. 9. FIG. 9 is an enlarged cross-sectional view of an edge portion LEP of the machined lens LE. In the example shown in FIG. 9, a bevel LV is formed for fitting the lens LE to the eyeglasses frame. A flat shoulder portion LK is formed between a base portion of the bevel LV and a front refractive surface LEf and a rear refractive surface LEr of the lens LE. Further, a chamfering portion Lm is formed at each of corners of the lens LE (ridge portion on the front refractive surface LEf side and ridge portion on the rear refractive surface LEr). It should be noted that a groove portion may be formed instead of the bevel LV.

As the cause of the malfunction that occurs in the shape of the edge portion LEP including at least any of the bevel LV, the shoulder portion LK, the chamfering portion Lm, and the groove portion, a case where the malfunction occurs in a relative movement of the lens LE and the machining tool in the X-axis direction, a case where the malfunction occurs in the measurement of the thickness of the lens LE (refractive surface shape measurement), and the like are considered. For example, as shown in FIG. 9, in a case where the malfunction occurs in the movement in the X-axis direction, a position of the bevel LV formed on the lens LE has a possibility of being deviated in the X-axis direction. Also, in a case where the thickness of the lens LE is not accurately measured, the position of the bevel LV formed on the edge portion LEP has a possibility of being deviated.

Therefore, in S14 and S17 in the present example, the content of the operation failure information is the operation failure related to the machining of the edge portion LEP of the lens LE (for example, the operation failure causing the malfunction of at least any of the shape, the position, and the size), the controller 50 includes the check operations of the motor 142 for X-axis movement and the lens refractive surface shape measurement unit 200A in the check operation to be actually implemented. As a result, it is facilitated to more appropriately estimate the cause of the operation failure related to the machining of the edge portion LEP.

In addition, in a case where the content of the operation failure information is the external size (finished external size) of the lens LE, as the cause of the malfunction that occurs in the shape, a case where the malfunction occurs in the relative movement between the lens LE and the machining tool in the Y direction (direction orthogonal to the X direction), a case where the machining tool is worn, a case where the malfunction occurs in the lens external shape measurement of the lens LE, and the like are considered. In these cases, the controller 50 includes the check operations of the motor 152 for Y-axis movement and the lens external shape measurement unit 200B in the check operation to be actually implemented. In addition, as the cause of the defect of the external size of the lens LE, there are a possibility that the malfunction occurs in the relative movement between the lens LE and the machining tool in the X-axis direction, a possibility that the malfunction occurs in a rotation angle of the lens holding shafts 102, and the like. The controller 50 may include the check operations of the motor 142 for X-axis movement, the motor 122 that rotates the lens holding shafts 102, and the like in the check operation to be actually implemented.

Also, in a case where the content of the operation failure information is an AXIS axial angle in the external shape of the lens LE, a possibility is considered that the malfunction occurs in the direction in which the lens holding shafts 102 are rotated. The controller 50 includes the check operation of the motor 122 that rotates the lens holding shafts 102 in the check operation to be actually implemented.

In addition, the controller 50 may include the operation of checking each of the origin sensors (114, 124, 144, 154, 224F, 224R, and 514) as the check operation actually implemented.

The description is returned to the description of FIGS. 7A and 7B. In a case where the operation failure information is not input by the operator (S15: NO), the controller 50 determines whether an instruction to implement all the check operations is input or not among the plurality of check operations that can be implemented by the eyeglasses lens machining apparatus 1 (S18). For example, in a case of executing the maintenance of the eyeglasses lens machining apparatus 1, the operator can input an instruction to implement all the check operations via the operation unit 55 or the like. In a case where the instruction is not input (S18: NO), the processing returns to S10. In a case where the instruction to implement all the check operations is input (S18: YES), the controller 50 selects all the plurality of check operations that can be implemented in the eyeglasses lens machining apparatus 1 as the check operation to be actually implemented (S19).

In a case where the check operation is selected in any of S14, S17, and S19, the selected check operation is implemented (S21 to S23). Specifically, in a case where at least any of the plurality of motors (112, 122, 142, 152, 216F, 216R, and 510) is selected as a target of the check operation, a check operation of a movement amount of the target motor is implemented (S21). In the check operation of the movement amount, an instruction to move the target object by a predetermined amount is given to the target motor. The target object to be moved may be an object other than the lens LE (for example, the carriage or the lens holding shaft). The movement includes linear movement as well as rotational movement or the like. In a case where the check operation of the movement amount (S21) is implemented, in processing in S24 described below, information indicating (for example, a difference between two values) a relationship between the movement amount instructed to the motor and the movement amount of the target object that is actually moved (for example, the movement amount detected by the encoder) is output as result information related to the check operation. As a result, it is facilitated to appropriately determine whether or not the cause of the operation failure is the malfunction related to the movement amount of the target object by the motor, based on the result of the operation check.

In addition, in a case where at least any of the plurality of motors (112, 122, 142, 152, 216F, 216R, and 510) is selected as a target of the check operation, a check operation of an origin movement of the target motor is implemented (S22). In the check operation of the origin movement, the target object is repeatedly moved to the origin position by the motor selected as the target. The target object to be moved may be an object other than the lens LE. The type of the movement may be rotational movement or the like instead of linear movement. In a case where the check operation of the origin movement (S22) is implemented, in the processing in S24 described below, information indicating a detection result of the origin position by the origin sensor is output as result information related to the check operation. As a result, it is facilitated to appropriately eliminate the malfunction of the origin detection that is likely to occur due to the machining waste or the like.

Next, the controller 50 executes a check operation other than the check operation of the movement amount and the check operation of the origin movement among the selected check operations (S23). In S23, for example, an operation of checking whether or not various signals are appropriately transmitted and received may be implemented.

Next, the controller 50 outputs the result information indicating the result of the implemented check operation (S24).

It should be noted that, in the operation check control processing, at least one of the detection of the operation failure in S10, the input of the operation failure information by the operator in S15, and the input of the instruction to implement all the check operations in S18 need only be implemented. For example, only the input of the operation failure information by the operator in S15 may be implemented.

<Determination Processing of Shift to Self-Restoration Processing>

Figure 10:
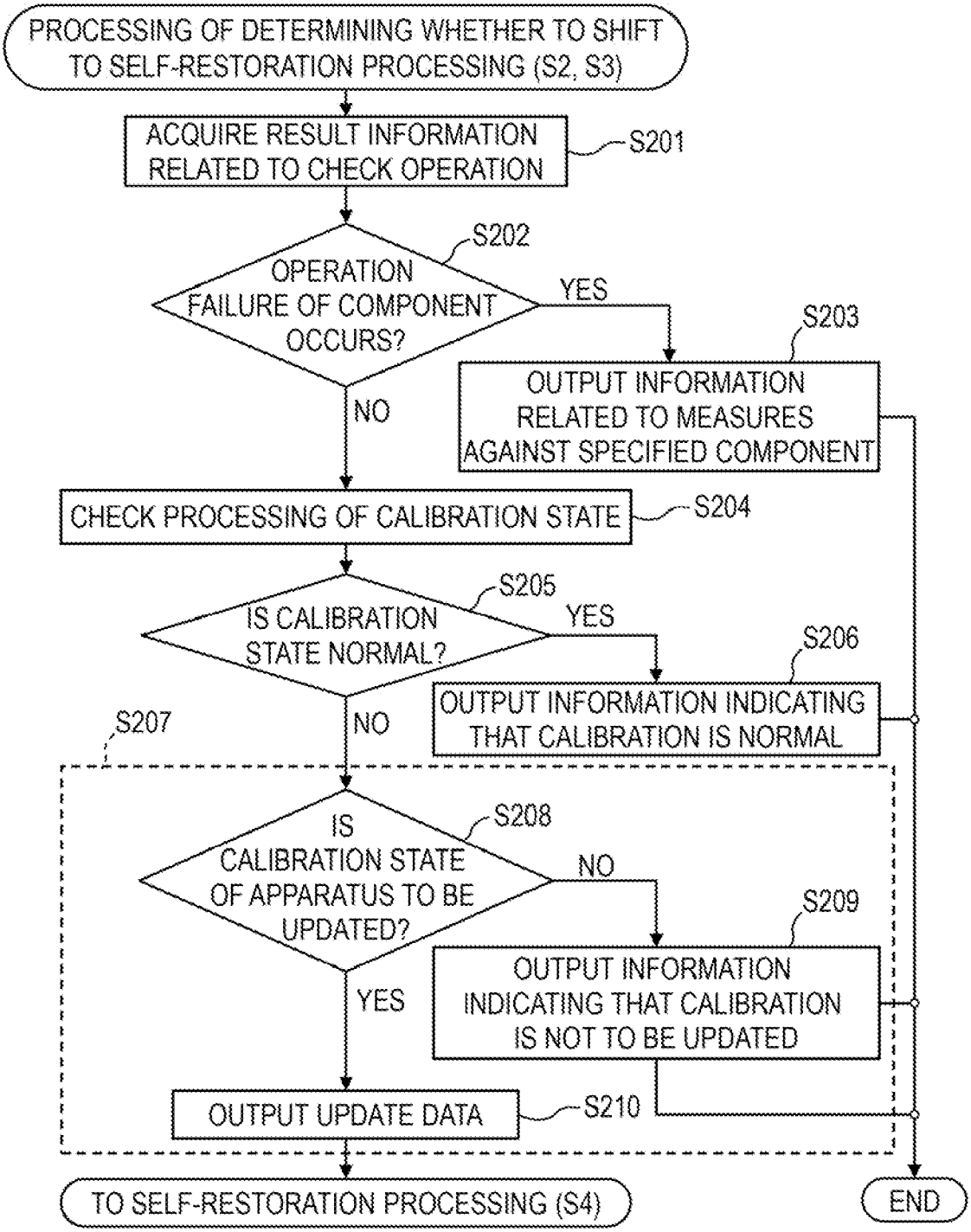
FIG. 10 is a flowchart of determination processing related to a shift to self-restoration processing.

After the operation check is implemented in the operation check control processing (S1), the determination processing (S2) of the shift to the self-restoration processing is performed. The determination processing (S2, S3) of the shift to the self-restoration processing will be described with reference to FIG. 10. FIG. 10 is a flowchart of the determination processing related to the shift to the self-restoration processing.

The controller 50 acquires the result information related to the check operation output in S24 (S201). Next, the controller 50 checks whether or not the operation failure of the component (for example, electric components, such as the motor and the origin sensor) occurs in the eyeglasses lens machining apparatus 1, based on the result information related to the check operation (S202). That is, the controller 50 determines whether to shift to step S203 or shift to step 204, which will be described below, based on the result information related to the check operation.

In a case where the operation failure of the component (S202: YES) occurs, the controller 50 outputs information related to measures against the specified component (S203). For example, in a case where it is confirmed that the failure (including trouble) of the motor (at least one of 112, 122, 142, 152, 216F, 216R, and 510) occurs, the information prompting the replacement of the motor is displayed on the display unit 60. For example, in a case where it is confirmed that the failure of the origin sensor (at least one of 114, 124, 144, 154, 224F, 224R, and 514) occurs, since there is a possibility of an incorrect reaction of the sensor due to the adhesion of machining waste, the information prompting the inspection, such as cleaning of the origin sensor, or the information prompting the replacement is displayed on the display unit 60. As a result, it is facilitated to take appropriate measures against the malfunction of the eyeglasses lens machining apparatus 1.

In a case where the component of the eyeglasses lens machining apparatus 1 is at fault, the measures by the expert (including a serviceman) who has a thorough knowledge of the eyeglasses lens machining apparatus 1 is necessary. Therefore, for example, in the output step in S203, the information related to the operation failure of the component may be transmitted to an information processing device at a base (hereinafter, referred to as a base B) different from a base (hereinafter, referred to as a base A) at which the eyeglasses lens machining apparatus 1 is installed, via the network connected to the eyeglasses lens machining apparatus 1. The expert who has a thorough knowledge of the eyeglasses lens machining apparatus 1 can access the information processing device at the base B, and can obtain the information related to the malfunction state of the eyeglasses lens machining apparatus 1.

In addition, for example, by displaying an identifier (for example, QR code (registered trademark)) indicating the result information related to the check operation on the display unit 60, the information related to the operation failure of the component may be output. For example, the operator causes an identifier reader to read the identifier displayed on the display unit 60. A terminal device connected to the identifier reader (for example, a portable terminal, such as a smartphone or a tablet terminal, can be used) transmits the result information acquired by reading the identifier to the information processing device at the base B via the network. Therefore, even in a case where the eyeglasses lens machining apparatus 1 is not connected to the network, the result information related to the operation check (including the information related to the operation failure of the component) is appropriately transmitted to the information processing device at the base B. As a result, it is facilitated to take more appropriate measures against the malfunction of the eyeglasses lens machining apparatus 1.

The description is returned to the description of FIG. 10. In a case where it is confirmed that no operation failure of the component occurs in S202 (S202: NO), processing of checking the calibration state of the eyeglasses lens machining apparatus 1 related to the malfunction state of the operation of the eyeglasses lens machining apparatus 1 is performed. For example, in order to check the calibration state of the eyeglasses lens machining apparatus 1, it is displayed on the display unit 70 that a calibration mode is to be set, a predetermined calibration lens LC (hereinafter, a lens LC) is to be held by the lens holding shafts 102, and the like. The operator sets the calibration mode by operating a switch on the operation unit 55, holds the lens LC by the lens holding shafts 102, and then inputs a start signal for a calibration operation by a machining start switch. It should be noted that, as an example of the lens LC, a regular square flat plate having a regular thickness and a regular length on each side may be used.

In the processing of checking the calibration state, the controller 50 selects the calibration item according to the content of the operation failure information checked in the operation check control processing in S1. Of course, the operator may input a signal for selecting the calibration item via the operation unit 55, based on the check result of the operation failure information. For example, in a case where the external size of the lens LE is faulty and the external size is selected as the calibration item, the following processing is performed to check the calibration state.

Figure 11:
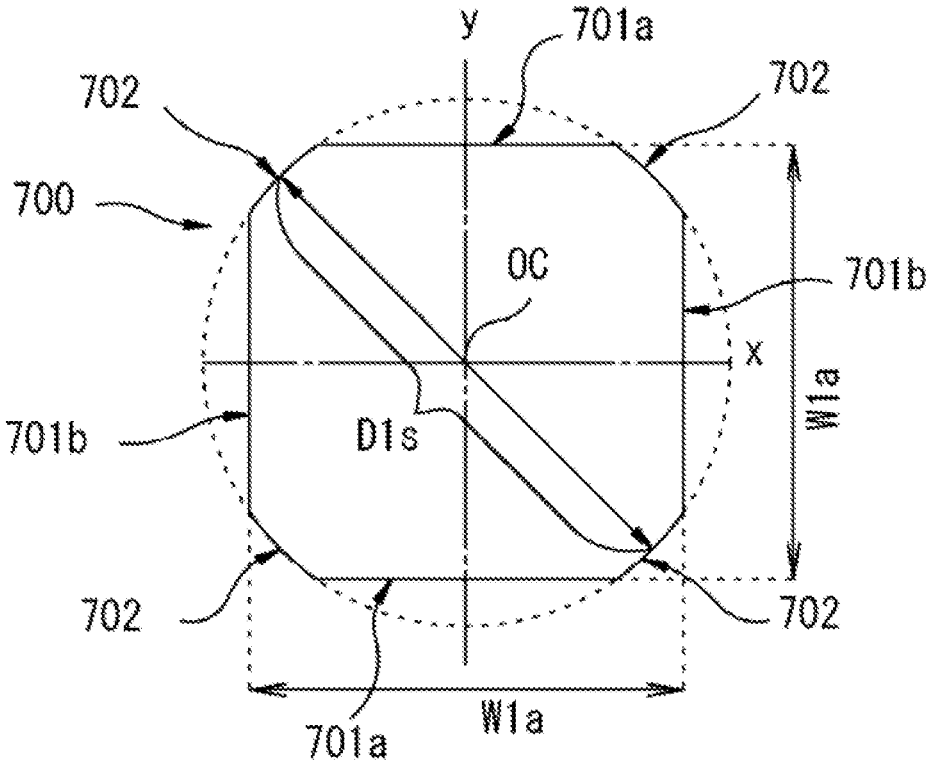
FIG. 11 is a diagram showing an example of a calibration target lens shape.

First, similarly to the machining of the normal lens LE, the edge positions of the front refractive surface and the rear refractive surface of the lens LC are measured by the lens refractive surface shape measurement unit 200A based on the calibration target lens shape 700 (see FIG. 11). It should be noted that the calibration target lens shape 700 is stored in the storage unit 70, and is acquired by the controller 50.

FIG. 11 is a diagram showing an example of the calibration target lens shape 700. The calibration target lens shape 700 according to the present example is set into a shape in which four corners of a square parallel to an x-axis and a y-axis for management of the target lens shape with a center OC (center held by the lens holding shafts 102) as a reference and having one side of size W1*a* are cut with a diameter D1*s* centered on the center OC. The calibration target lens shape 700 has a linear region 701*a* parallel to the x-axis, a linear region 701*b* parallel to the y-axis, and a partial circular region 702 with the center OC as a reference. It should be noted that the x-axis and the y-axis of the target lens shape are different from the X direction and the Y direction of the eyeglasses lens machining apparatus 1 shown in FIG. 1, are axes for management of the target lens shape, and are set as axes having a predetermined relationship with the rotation angle θ of the lens holding shafts 102. For example, an x-axis direction is set at the rotation angle θ=0 degrees of the lens holding shafts 102.

In a case where the edge positions of the front refractive surface and the rear refractive surface of the lens LC are acquired, the controller 50 calculates bevel path data for forming the bevel on the peripheral edge of the lens LC based on edge position information. For example, the bevel path data is calculated assuming that a path of a bevel apex is disposed at a position dividing an edge thickness by a ratio of 5:5.

In a case where the bevel path data is obtained, the drive of each motor of the movement unit 120 is controlled by the controller 50, and the peripheral edge of the lens LC is roughly machined by the rough grindstone 322 based on the calibration target lens shape 700. Thereafter, the drive of each motor of the movement unit 120 is controlled, and the peripheral edge of the lens LC after the roughing is subjected to bevel-finishing by the finishing grindstone 324 based on the calibration target lens shape 700 and the bevel path data.

After the finishing, the lens external shape measurement unit 200B is operated. A measurement result of the external shape of the lens LC is obtained by bringing the tracing stylus 520 into contact with the peripheral edge of the machined lens LC and rotating the lens LC once. Then, by comparing the measurement result of the external shape with the data of the calibration target lens shape 700, the calibration state related to the external size is checked. More specifically, by comparing the measurement result of the diameter D1*s* in the circular region 702 with the data of the calibration target lens shape 700, data of the calibration state (difference data in the comparison results between the two) related to the external size is obtained.

In addition, in a case where the axial angle of the eyeglasses lens (deviation in the rotation angle of the eyeglasses lens) is selected as the calibration item, by comparing the measurement result obtained in the state that the tracing stylus 520 contacts a portion of the linear region 701*b* of the calibration target lens shape 700 in the peripheral edge of the machined lens LC with the data of the calibration target lens shape 700, the calibration state related to the axial angle is checked by the controller 50.

In addition, in a case where the bevel position is selected as the calibration item, the lens external shape measurement unit 200B is operated and the calibration state is checked as follows.

First, the lens LC is moved in the X direction in the state that the bevel apex of the machined lens LC contacts the small-diameter cylindrical portion 521*b* formed on the tracing stylus 520. With this movement, in a case in which the bevel apex of the lens LC enters the groove 521*v*, a distance from the lens holding center measured by the encoder 511 is changed. Then, the position in the X direction when the distance measured by the encoder 511 is the minimum is obtained as the position of the bevel apex in the X direction. The controller 50 compares the measurement result of the bevel apex with set data of the bevel path in the calibration target lens shape 700 to check the calibration state of the bevel position.

Heretofore, an example of the calibration item has been described, but the chamfering by the chamfering tool 360, the grooving by the grooving tool 436, the drilling by the drilling tool 435, and the like may be selected as the calibration item. It should be noted that, as the detailed check method of the calibration states, the technology disclosed in JP2011-73134A can be used.

The description is returned to the description of FIG. 10. After the calibration state of the eyeglasses lens machining apparatus 1 related to the malfunction state is checked in S204, it is checked whether or not the calibration state is normal (for example, within a predetermined tolerance value) (S205). In a case where the calibration state is normal (S205: YES), it is determined that the shift to the self-restoration processing (S4) is unnecessary, and the information indicating that the calibration state is normal is output (S206). For example, the information indicating that the calibration state is normal is displayed on the display unit 60. For example, in a case where the calibration state is normal though the external size is faulty, since it is considered that an adjustment value of a parameter related to the external size has an influence, it may be output at the same time that the change of the adjustment value is necessary.

In a case where the calibration state is faulty (S205: NO), the information related to the self-restoration implemented in S4 is output (S207). For example, the information related to the self-restoration includes the update data (which may be correction data) for updating the calibration state. The update data is obtained by calculating a difference between various measurement results of the machined lens LC and a reference shape based on the calibration target lens shape 700.

It should be noted that the information related to the self-restoration may include the information for inquiring of the operator whether or not to update the calibration state. For example, the inquiry is made as to whether or not to update the calibration state of the eyeglasses lens machining apparatus 1 (S208). For example, an inquiry screen similar to the inquiry screen in FIG. 8 is displayed on the display unit 60. In a case where the operator inputs a response indicating that the calibration state is not to be updated (S208: NO), information indicating that the calibration state is not to be updated is output (S209). In a case where the operator inputs a response indicating that the calibration state is to be updated (that is, in a case where permission to update the calibration state is given) (S208: YES), it is determined to shift to the self-restoration processing, and the update data of the calibration state is output (S210).

In a case where the update data of the calibration state is output in S210, the controller 50 updates the calibration state (in other words, updates a calibration parameter) in each unit of the eyeglasses lens machining apparatus 1 based on the update data, thereby executing the self-restoration processing for the malfunction of the operation of the eyeglasses lens machining apparatus 1 (S4). That is, the controller 50 executes the self-restoration processing by updating the calibration state such that the calibration state of the eyeglasses lens machining apparatus 1 related to the malfunction state checked in the operation check control processing in S1 is appropriate. As a result, even in a case where the expert who has a thorough knowledge of the eyeglasses lens machining apparatus 1 cannot be involved, appropriate measure is taken against the malfunction of the operation of the eyeglasses lens machining apparatus 1.

Modification Example

The technology disclosed in the example described above is merely an example. Therefore, various modifications can be made to the technology described in the example described above. For example, in S208, the inquiry to the operator as to whether or not to update the calibration state is not made, and in a case where the calibration state is faulty (S205: NO), the calibration state update data is output as the information related to the self-restoration, and the self-restoration processing in S4 may be performed.

Also, the determination of the shift to the self-restoration processing may be performed in two stages. For example, in the first stage, the processing of checking whether or not the operation failure of the component occurs in the eyeglasses lens machining apparatus 1 in S202 may be omitted. Thereafter, in a case where it is confirmed that no malfunction occurs in the operation of the eyeglasses lens machining apparatus 1 when the check operation control processing in S1 is again implemented after the self-restoration processing is implemented in S4, the processing is terminated. In a case where it is detected that the malfunction occurs in the operation of the eyeglasses lens machining apparatus 1 in the second implementation of the check control processing, the processing of checking whether or not the operation failure of the component occurs in the eyeglasses lens machining apparatus 1 in S202 need only be performed.

What is claimed is:

1. A non-transitory computer-readable storage medium storing a management program of an eyeglasses lens machining apparatus including a controller configured to control the eyeglasses lens machining apparatus, the management program comprising instructions which, when executed by the controller, cause the eyeglasses lens machining apparatus to perform:

a check operation implementation step of causing the eyeglasses lens machining apparatus to implement a check operation for checking a malfunction state including an operation failure requiring inspection or replacement of a component of the eyeglasses lens machining apparatus;

a self-restoration step of updating a calibration state of the eyeglasses lens machining apparatus related to the malfunction state, to self-restore the eyeglasses lens machining apparatus from the malfunction state; and a determination step of determining whether or not to shift to the self-restoration step, based on a result of the check operation.

2. The storage medium according to claim 1, wherein the management program comprises instructions which cause the controller to further perform:

a measures output step of outputting information related to measures against an operation failure requiring inspection or replacement of a component in the eyeglasses lens machining apparatus, and wherein, in the determination step, it is determined whether to shift to the measures output step or shift to the self-restoration step, based on the result of the check operation.

3. The storage medium according to claim 2, wherein the management program comprises instructions which cause the controller to further perform:

a failure check step of checking whether or not the operation failure of the component occurs in the eyeglasses lens machining apparatus, based on the result of the check operation, and wherein, in the determination step, it is determined to shift to the measures output step, in a case where it is confirmed that the operation failure of the component occurs in the eyeglasses lens machining apparatus in the failure check step.

4. The storage medium according to claim 3, wherein the management program comprises instructions which cause the controller to further perform:

a calibration check step of checking the calibration state of the eyeglasses lens machining apparatus related to the malfunction state, in a case where it is confirmed that no failure of the component occurs in the eyeglasses lens machining apparatus in the failure check step, and wherein, in the determination step, it is determined that a shift to the self-restoration step is unnecessary, in a case where it is confirmed that the calibration state is normal in the calibration check step.

5. The storage medium according to claim 4, wherein the determination step includes a restoration information output step of outputting information related to the self-restoration, in a case where it is confirmed that the calibration state is faulty in the calibration check step.

6. The storage medium according to claim 5, wherein the information related to the self-restoration output in the restoration information output step includes information for inquiring of an operator whether or not to update the calibration state, and wherein, in the determination step, it is determined to shift to the self-restoration step, in a case where the operator gives permission to update the calibration state.

7. The storage medium according to claim 1, wherein the check operation implemented in the check operation implementation step includes at least one of a check operation for a malfunction in a direction along lens holding shafts that interpose and hold an eyeglasses lens, a check operation for a malfunction in a direction orthogonal to the lens holding shafts, and a check operation for a malfunction in a direction where the lens holding shafts are rotated.

8. An eyeglasses lens machining apparatus comprising a controller configured to execute the management program stored in the non-transitory computer-readable storage medium according to claim 1.

9. The storage medium according to claim 1, wherein the instructions which, when executed by the controller, cause the eyeglasses lens machining apparatus to perform a failure check step of confirming, based on a result of the check operation, whether there is an operation failure requiring inspection or replacement of a component of the eyeglasses lens machining apparatus;

and wherein, the determination step determines not to shift to the self-restoration step when the check step confirms there is an operation failure requiring inspection or replacement of a component of the eyeglasses lens machining apparatus.

10. The storage medium according to claim 1, wherein the instructions which, when executed by the controller, cause the eyeglasses lens machining apparatus to perform the check operation implementation step in a state when a lens is not held by lens holding shafts in the eyeglasses lens machining apparatus.

11. A method of managing an eyeglasses lens machining apparatus including a controller configured to perform the method comprising:

a check operation implementation step of causing the eyeglasses lens machining apparatus to implement a check operation for checking a malfunction state including an operation failure requiring inspection or replacement of a component of the eyeglasses lens machining apparatus;

a self-restoration step of updating a calibration state of the eyeglasses lens machining apparatus related to the malfunction state, to self-restore the eyeglasses lens machining apparatus from the malfunction state; and a determination step of determining whether to shift to the self-restoration step, based on a result of the check operation.

12. The method according to claim 11, the method further comprising:

a measures output step of outputting information related to measures against an operation failure requiring inspection or replacement of a component in the eyeglasses lens machining apparatus, wherein, in the determination step, it is determined whether to shift to the measures output step or shift to the self-restoration step, based on the result of the check operation.

13. The method according to claim 12, the method further comprising:

a failure check step of checking whether or not the operation failure of the component occurs in the eyeglasses lens machining apparatus, based on the result of the check operation, wherein, in the determination step, it is determined to shift to the measures output step, in a case where it is confirmed that the operation failure of the component occurs in the eyeglasses lens machining apparatus in the failure check step.

14. The method according to claim 13, the method further comprising:

a calibration check step of checking the calibration state of the eyeglasses lens machining apparatus related to the malfunction state, in a case where it is confirmed that no failure of the component occurs in the eyeglasses lens machining apparatus in the failure check step, wherein, in the determination step, it is determined that a shift to the self-restoration step is unnecessary, in a case where it is confirmed that the calibration state is normal in the calibration check step.

15. The method according to claim 14, wherein the determination step includes a restoration information output step of outputting information related to the self-restoration, in a case where it is confirmed that the calibration state is faulty in the calibration check step.

16. The method according to claim 15, wherein the information related to the self-restoration output in the restoration information output step includes information for inquiring of an operator whether or not to update the calibration state, and wherein, in the determination step, it is determined to shift to the self-restoration step, in a case where the operator gives permission to update the calibration state.

17. The method according to claim 11, wherein the check operation implemented in the check operation implementation step includes at least one of a check operation for a malfunction in a direction along lens holding shafts that interpose and hold an eyeglasses lens, a check operation for a malfunction in a direction orthogonal to the lens holding shafts, and a check operation for a malfunction in a direction where the lens holding shafts are rotated.

18. The method according to claim 11, comprising a failure check step of confirming, based on a result of the check operation, whether there is an operation failure requiring inspection or replacement of a component of the eyeglasses lens machining apparatus;

and wherein, the determination step determines not to shift to the self-restoration step when the check step confirms there is an operation failure requiring inspection or replacement of a component of the eyeglasses lens machining apparatus.

19. The method according to claim 11, wherein the check operation implementation step is carried out in a state when a lens is not held by lens holding shafts in the eyeglasses lens machining apparatus.

* * * * *